US011261768B2

(12) United States Patent
Tawada et al.

(10) Patent No.: US 11,261,768 B2
(45) Date of Patent: Mar. 1, 2022

(54) MUFFLER

(71) Applicant: FUTABA INDUSTRIAL CO., LTD., Okazaki (JP)

(72) Inventors: Hayato Tawada, Okazaki (JP); Shinnosuke Toichi, Okazaki (JP); Katsuhiko Kainuma, Okazaki (JP)

(73) Assignee: FUTABA INDUSTRIAL CO., LTD., Okazaki (JP)

( * ) Notice: Subject to any disclaimer, the term of this patent is extended or adjusted under 35 U.S.C. 154(b) by 381 days.

(21) Appl. No.: 16/255,091

(22) Filed: Jan. 23, 2019

(65) Prior Publication Data

US 2019/0234263 A1 Aug. 1, 2019

(30) Foreign Application Priority Data

Jan. 26, 2018 (JP) ..... JP2018-011860
Jun. 27, 2018 (JP) ..... JP2018-122182

(51) Int. Cl.
*F01N 1/02* (2006.01)
*F01N 13/18* (2010.01)
*G10K 11/172* (2006.01)

(52) U.S. Cl.
CPC ..... *F01N 1/023* (2013.01); *F01N 1/026* (2013.01); *F01N 13/1838* (2013.01);
(Continued)

(58) Field of Classification Search
CPC ..... F01N 1/023; F01N 1/026; F01N 2470/08; F01N 2470/10; F01N 2470/24; F01N 13/1838
See application file for complete search history.

(56) References Cited

U.S. PATENT DOCUMENTS 2,511,359 A * 6/1950 Mcleod ..... F01N 1/14 181/262
3,414,078 A * 12/1968 Andersson ..... F01N 1/02 181/250

(Continued)

FOREIGN PATENT DOCUMENTS

CN 105275562 A 1/2016
CN 206035619 U 3/2017

(Continued)

OTHER PUBLICATIONS

Examination Report for Indian Patent Application No. 201934002643, dated May 28, 2020, 5 pages.

(Continued)

*Primary Examiner* — Jeremy A Luks
(74) *Attorney, Agent, or Firm* — Withrow & Terranova, P.L.L.C.; Vincent K. Gustafson

(57) ABSTRACT

A muffler including a double-pipe structure to muffle sounds in two or more frequencies is provided. The muffler includes an inner and outer pipes with a clearance therebetween. The inner pipe includes a first and second outer surfaces, and, at one end, an opening communicating with the outer pipe. The clearance communicates with an exhaust passage via the opening. The second outer surface forms the opening and is situated closer to the center of the inner pipe than the first outer surface is. A space between the inner and outer pipes is closed due to a contact between the first outer surface and an inner-circumferential surface of the outer pipe. A part of the clearance is formed between the first outer surface and the inner-circumferential surface. The outer-circumferential surfaces of the inner pipe include at least one communication hole that communicates the inner pipe with the clearance.

9 Claims, 8 Drawing Sheets

(52) U.S. Cl.
CPC ..... *G10K 11/172* (2013.01); *F01N 2470/08* (2013.01); *F01N 2470/10* (2013.01); *F01N 2470/24* (2013.01)

(56) References Cited

U.S. PATENT DOCUMENTS

| | | | | |
|---|---|---|---|---|
| 3,500,954 | A * | 3/1970 | Willette | F01N 1/006 181/232 |
| 3,752,260 | A * | 8/1973 | Heath | F01N 13/02 181/228 |
| 4,589,515 | A * | 5/1986 | Omura | F01N 13/082 181/227 |
| 5,907,134 | A * | 5/1999 | Nording | F16L 51/00 181/228 |
| 7,997,382 | B2 * | 8/2011 | Hagiwara | F01N 1/04 181/249 |
| 8,550,122 | B2 * | 10/2013 | Derry | F01N 13/1805 138/108 |
| 8,607,923 | B2 * | 12/2013 | Takagaki | F01N 1/02 181/249 |
| 8,770,341 | B2 | 7/2014 | Wood et al. | |
| 9,890,774 | B2 | 2/2018 | Wood et al. | |
| 2006/0054381 | A1 * | 3/2006 | Takemoto | F28D 7/103 181/237 |
| 2009/0078499 | A1 | 3/2009 | Sikes et al. | |
| 2013/0327417 | A1 * | 12/2013 | Gardner | F01N 13/08 137/115.11 |
| 2015/0337699 | A1 | 11/2015 | Kainuma et al. | |
| 2015/0361841 | A1 | 12/2015 | Abram et al. | |
| 2017/0074220 | A1 | 3/2017 | Hartmann et al. | |
| 2017/0122154 | A1 | 5/2017 | Marquardt-Stammberger et al. | |
| 2018/0266301 | A1 | 9/2018 | Higashino et al. | |

FOREIGN PATENT DOCUMENTS

| | | | | |
|---|---|---|---|---|
| EP | 2201225 | B1 | | 2/2012 |
| EP | 3163038 | A1 | | 5/2017 |
| JP | S57113919 | A | | 7/1982 |
| JP | S62271919 | A | | 11/1987 |
| JP | 09133019 | A | * | 5/1997 |
| JP | 2005105918 | A | | 4/2005 |
| JP | 2014134180 | A | | 7/2014 |
| JP | 2015163777 | A | | 9/2015 |
| JP | 2016051710 | A | | 4/2016 |
| WO | 2017126508 | A1 | | 4/2018 |

OTHER PUBLICATIONS

Notice of Reasons for Refusal for Japanese Patent Application No. 2018-122182 dated Feb. 4, 2020, 15 pages including English translation.

Second Office Action for Chinese Patent Application No. 201910068427.8, dated Mar. 18, 2021, 18 pages.

Office Action for Indonesian Patent Application No. P-00201900514, dated Jan. 19, 2021, 3 pages.

First Office Action for Chinese Patent Application No. 201910068427.8 dated Sep. 2, 2020, 20 pages including English translation.

Notice of Reasons for Refusal for Japanese Patent Application No. 2018-122182 dated Apr. 21, 2020, 15 pages including English translation.

Search Report for Turkish Patent Application No. 2019/00951, dated Jun. 22, 2021, 8 pages including English translation.

* cited by examiner

MUFFLER

CROSS-REFERENCE TO RELATED APPLICATIONS

This application claims the benefit of Japanese Patent Application No. 2018-011860 filed on Jan. 26, 2018 in the Japan Patent Office and Japanese Patent Application No. 2018-122182 filed on Jun. 27, 2018 in the Japan Patent Office, wherein the entire disclosures of the foregoing applications are hereby incorporated by reference herein.

BACKGROUND

The present disclosure relates to a muffler.

As an exhaust system for automobiles, a system comprising a sub-muffler between a catalyst situated upstream of an exhaust gas flow passage and a main muffler situated downstream of the exhaust gas flow passage is known.

One disclosed muffler as the sub-muffler is a resonant-type muffler having a double-pipe structure comprising an inner pipe and an outer pipe (see, International Publication No. WO2017/126508). This resonant-type muffler is designed such that the inner pipe has an opening that provides an access from an exhaust passage of the inner pipe to a clearance between the inner pipe and the outer pipe.

SUMMARY

The muffler in the aforementioned publication can muffle a sound in only one frequency; and thus the muffler needs to be designed separately for every single frequency. Accordingly, two or more mufflers are required to muffle sounds in two or more frequencies.

Preferably, one aspect of the present disclosure is to provide a muffler with a double-pipe structure that can muffle sounds in two or more frequencies.

One aspect of the present disclosure is a muffler comprising an inner pipe having a cylindrical shape, and an outer pipe having a cylindrical shape. The inner pipe is situated in an inner side of the outer pipe. The inner pipe and the outer pipe together form a double pipe. The double pipe comprises a first double-pipe end and a second double-pipe end. The double pipe is configured to form a first exhaust passage. The first exhaust passage couples a first flow passage to a second flow passage via the inner pipe such that one of the first double-pipe end or the second double-pipe end is coupled to the first flow passage in an upstream of exhaust flow and the other one of the first double-pipe end or the second double-pipe end is coupled to the second flow passage in a downstream of the exhaust flow. A clearance is provided between the inner pipe and the outer pipe. An opening connecting the inner pipe to the outer pipe is provided at the second double-pipe end. The clearance communicates with the first exhaust passage via the opening.

The inner pipe comprises an outer-circumferential surface. The outer-circumferential surface includes, at the second double-pipe end, a first outer surface, and a second outer surface. The second outer surface forms the opening and is situated closer to the center axis of the inner pipe than the first outer surface is. A space between the inner pipe and the outer pipe is closed due to a contact between the first outer surface of the inner pipe and an inner-circumferential surface of the outer pipe, or with an inclusion interposed between the first outer surface of the inner pipe and the inner-circumferential surface of the outer pipe. A first part of the clearance is formed between the first outer surface of the inner pipe and the inner-circumferential surface of the outer pipe. The outer-circumferential surface of the inner pipe comprises at least one communication hole that communicates the inner pipe with the clearance.

This configuration provides a side-branch muffler with the clearance communicated with the first exhaust passage through the opening and the communication hole, and therefore enables muffling of sounds in two or more frequencies by the side branch.

In one aspect of the present disclosure, the inner pipe may comprise a first-diameter portion, and a second-diameter portion having an outer diameter smaller than an outer diameter of the first-diameter portion. A resonance chamber, corresponding to the first part of the clearance, may be formed between the outer-circumferential surface of the second-diameter portion and the inner-circumferential surface of the outer pipe. The first-diameter portion may comprise the first outer surface and the second outer surface. A resonance pipe, corresponding to a second part of the clearance, may be formed between the second outer surface and the inner-circumferential surface of the outer pipe. The opening is situated in one end of the resonance pipe. The resonance pipe and the resonance chamber may function as a Helmholtz resonator due to the resonance pipe communicating with the first exhaust passage via the opening and due to the resonance chamber communicating with the first exhaust passage via the resonance pipe. The muffler may function as a side-branch muffler due to the first exhaust passage communicating with the clearance via the at least one communication hole. This configuration enables muffling by Helmholtz resonance and muffling by the side branch to be compatible with each other.

In one aspect of the present disclosure, an outer diameter of the outer pipe in an area forming the clearance may be equal to or smaller than an outer diameter of the outer pipe at the second double-pipe end. This configuration enables a reduction of the outer diameter of the muffler to save space for installation.

In one aspect of the present disclosure, in an event that air column resonance occurs in a second exhaust passage, the second exhaust passage being formed with exhaust-passage components comprising the muffler, the opening may be arranged at a location corresponding to a location of an antinode of standing waves in the second exhaust passage. This configuration enables more reliable muffling effect.

In one aspect of the present disclosure, the inner pipe may be bonded with the outer pipe as the first outer surface contacts the inner-circumferential surface of the outer pipe. In this configuration, the clearance between the inner pipe and the outer pipe can be formed more easily and reliably.

In one aspect of the present disclosure, a space between the inner pipe and the outer pipe may be closed with an inclusion interposed between the outer-circumferential surface of the inner pipe and the inner-circumferential surface of the outer pipe near the first double-pipe end. This configuration enables the outer pipe to axially slide with respect to the inner pipe when there is a difference in thermal expansion between the inner pipe, through which the exhaust gas flows, and the outer pipe disposed outside of the inner pipe in response to the use of the muffler (in other words, when the exhaust gas flows though the muffler). Accordingly, stress concentration at connected areas of the inner pipe and the outer pipe can be reduced, which can lead to a reduction of occurrence of cracks.

In one aspect of the present disclosure, the inclusion may be wire mesh. This configuration enables the outer pipe to slide with respect to the inner pipe more easily and reliably while the clearance is formed between the inner pipe and the outer pipe.

In one aspect of the present disclosure, the inner pipe may be bonded with the outer pipe near the first double-pipe end as the first outer surface contacts the inner-circumferential surface of the outer pipe. In this configuration, the clearance between the inner pipe and the outer pipe can be formed more easily and reliably.

In one aspect of the present disclosure, in an event that air column resonance occurs in the second exhaust passage, the second exhaust passage being formed with the exhaust-passage components comprising the muffler, the at least one communication hole may be arranged at a location corresponding to a location of an antinode of standing waves in the second exhaust passage. This configuration enables more reliable muffling effect.

Another aspect of the present disclosure is a muffler comprising an inner pipe having a cylindrical shape, and an outer pipe having a cylindrical shape. The inner pipe is situated in an inner side of the outer pipe. The inner pipe and the outer pipe together form a double pipe. The double pipe comprises a first double-pipe end and a second double-pipe end. The double pipe is configured to form a first exhaust passage coupling a first flow passage to a second flow passage via the inner pipe such that one of the first double-pipe end or the second double-pipe end is coupled to the first flow passage in an upstream of exhaust flow and the other one of the first double-pipe end or the second double-pipe end is coupled to the second flow passage in a downstream of exhaust flow. A clearance is provided between the inner pipe and the outer pipe. A space between the inner pipe and the outer pipe is closed at the second double-pipe end due to a contact between an outer-circumferential surface of the inner pipe and an inner-circumferential surface of the outer pipe, or with an inclusion interposed between the outer-circumferential surface of the inner pipe and the inner-circumferential surface of the outer pipe. The outer-circumferential surface of the inner pipe comprises at least one communication hole that communicates the inner pipe with the clearance.

In this configuration, a side-branch muffler is formed with the clearance that is communicated with the inner pipe through the communication hole. This configuration therefore enables muffling of sounds in two or more frequencies by the side branch.

In one aspect of the present disclosure, the inner pipe may be bonded with the outer pipe at the second double-pipe end as the outer-circumferential surface of the inner pipe contacts the inner-circumferential surface of the outer pipe. In this configuration, the clearance between the inner pipe and the outer pipe can be formed more easily and reliably.

In one aspect of the present disclosure, a space between the inner pipe and the outer pipe may be closed with an inclusion interposed between the outer-circumferential surface of the inner pipe and the inner-circumferential surface of the outer pipe near the first double-pipe end. This configuration enables the outer pipe to axially slide with respect to the inner pipe when there is a difference in thermal expansion between the inner pipe, through which the exhaust gas flows, and the outer pipe disposed outside of the inner pipe. Accordingly, stress concentration at connected areas of the inner pipe and the outer pipe can be reduced.

In one aspect of the present disclosure, the inner pipe may be bonded with the outer pipe near the first double-pipe end as the outer-circumferential surface of the inner pipe contacts the inner-circumferential surface of the outer pipe. In this configuration, the clearance between the inner pipe and the outer pipe can be formed more easily and reliably.

In one aspect of the present disclosure, in an event that air column resonance occurs in the second exhaust passage, the second exhaust passage being formed with exhaust-passage components comprising the muffler, the at least one communication hole may be arranged at a location corresponding to a location of an antinode of standing waves in the second exhaust passage. This configuration enables more reliable muffling effect.

In one aspect of the present disclosure, a cross-sectional area of the clearance may be equal to or smaller than a cross-sectional area of a hollow part of the inner pipe. In this configuration, an outer diameter of the muffler can be reduced to save space for installation. In addition, since the muffler can be bent, the muffler can be more flexibly arranged.

BRIEF DESCRIPTION OF THE DRAWINGS

An example embodiment of the present disclosure will be described hereinafter with reference to the accompanying drawings, in which.

DETAILED DESCRIPTION OF THE PREFERRED EMBODIMENTS

1. First Embodiment

[1-1. Configuration]

Figure 1:
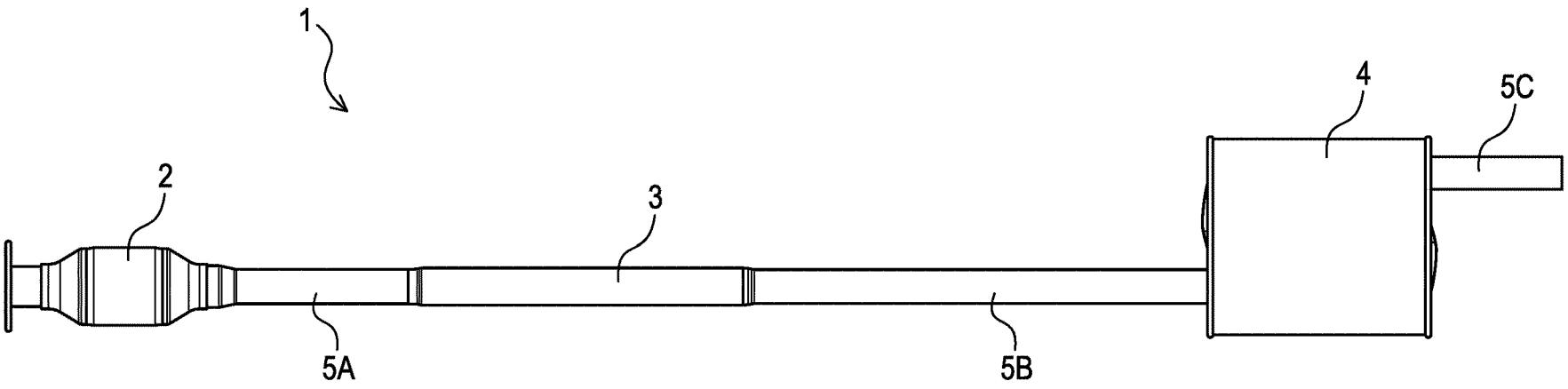
FIG. 1 is a schematic plan view showing an exhaust system of an embodiment.

As shown in FIG. 1, an exhaust system 1 forms an exhaust gas flow passage for an exhaust gas from an internal combustion engine. The exhaust system 1 comprises a catalytic converter 2, a muffler 3 as a sub-muffler, and a main muffler 4.

The exhaust system 1 can be used in any internal combustion engines without a particular limitation, including those used for transportation equipment such as automobiles, railways, vessels, and construction machines, and those used for drivers or generators in power facilities.

The catalytic converter 2 reforms or collects environmental pollutants in the exhaust gas. The catalytic converter 2 comprises a catalyst. The main muffler 4 further muffles exhaust sound of the exhaust gas that comes passing the muffler 3.

The catalytic converter 2 is coupled to the muffler 3 via a first pipe 5A. The muffler 3 is coupled to the main muffler 4 via a second pipe 5B. After passing the main muffler 4, the exhaust gas is discharged from a third pipe 5C.

<Muffler>

Figure 2A:
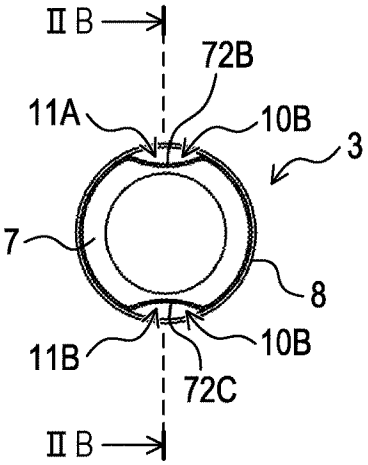
FIG. 2A is a schematic side view showing the muffler of FIG. 1 viewed from a second double-pipe end of the muffler.
Figure 2B:
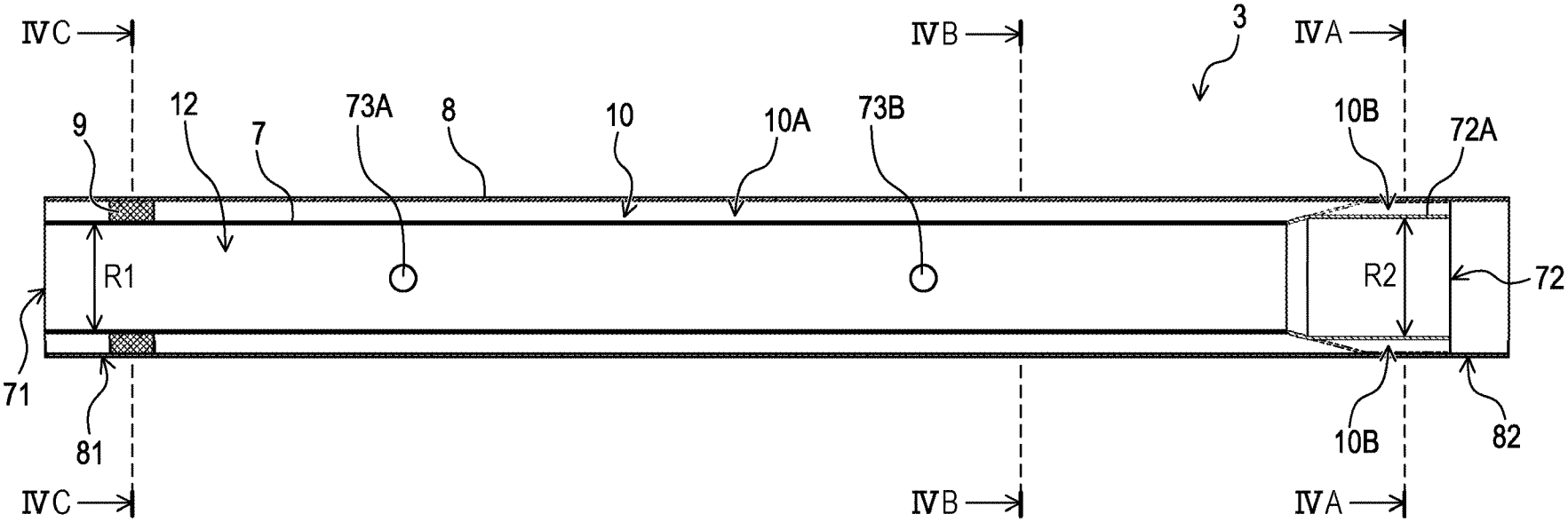
FIG. 2B is a schematic cross-sectional diagram of the muffler of FIG. 1 taken along a line IIB-IIB of FIG. 2A.

As shown in FIG. 2A and FIG. 2B, the muffler 3 comprises an inner pipe 7 having a cylindrical shape, an outer pipe 8 having a cylindrical shape, and an inclusion 9. The muffler 3 has a double-pipe structure. The muffler 3 configures the first exhaust passage 12.

<Inner Pipe>

The inner pipe 7 is configured to carry the exhaust gas. More specifically, after passing the catalytic converter 2, the exhaust gas is introduced into the inner pipe 7 through one of a first inner-pipe end 71 or a second inner-pipe end 72, and discharged from the other one of the first inner-pipe end 71 or the second inner-pipe end 72.

The inner pipe 7 comprises communication holes 73A, 73B (the first communication hole 73A, the second communication hole 73B). Each of the communication holes 73A, 73B communicates the inner side of the inner pipe 7 with a clearance 10. The clearance 10 is situated between the outer pipe 8 and the inner pipe 7; the detail is explained later. The communication holes 73A, 73B are situated away from each other along the axis of the inner pipe 7 (in other words, in the longitudinal directions). The communication holes 73A, 73B are situated between a first outer-pipe end 81 and a second outer-pipe end 82 of the outer pipe 8 along the axis of the inner pipe 7.

Figure 3A:
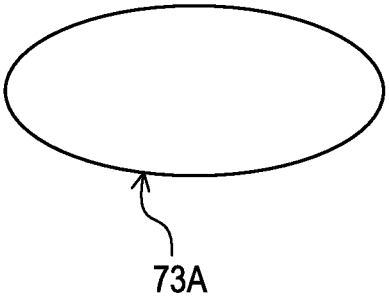
FIG. 3A, 3B, 3C are schematic diagrams describing shapes of a communication hole.
Figure 3B:
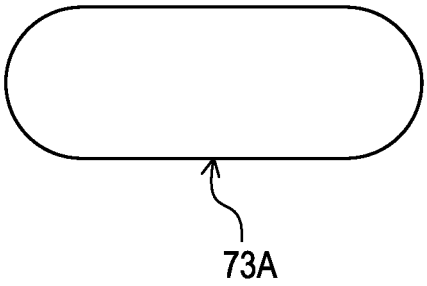
Figure 3C:
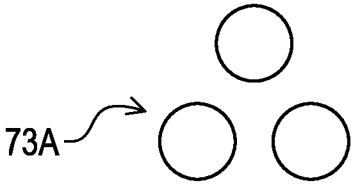

The shape of the communication holes 73A, 73B need not be a true circle as long as the shape provides adequate area for a side-branch muffler to function. The communication holes 73A, 73B may be other shapes such as an ellipse (see FIG. 3A), a polygon, a rounded polygon (see FIG. 3B), and a star. Each of the communication holes 73A, 73B may also be divided into small holes (in other words, an assembly of small holes, see FIG. 3C).

A second exhaust passage is the whole exhaust passage disposed in the entire exhaust system 1 shown in FIG. 1. The second exhaust passage thus comprises exhaust-passage components comprising the muffler 3. In an event that air column resonance occurs in the second exhaust passage, each communication holes 73A, 73B are arranged at locations corresponding to locations of an antinode of standing waves in the second exhaust passage.

Figure 4A:
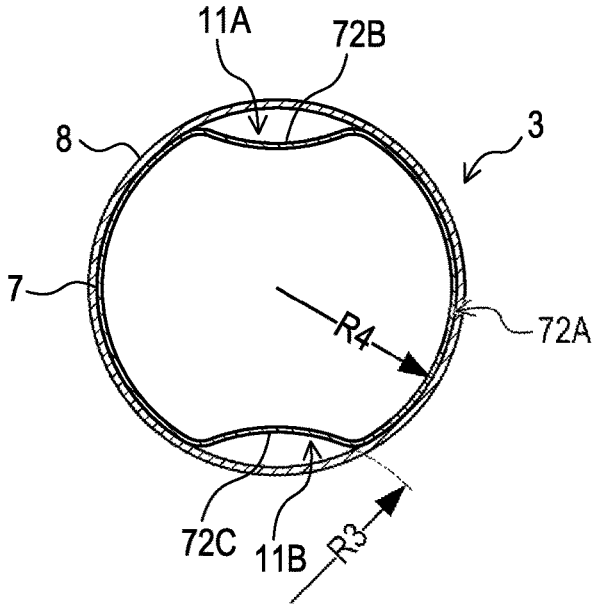
FIG. 4A is a schematic cross-sectional diagram taken along a line IVA-IVA of FIG. 2B.

An inner diameter R2 of the second inner pipe end 72 is greater than an inner diameter R1 of the first inner pipe end 71. The second inner-pipe end 72 comprises a fixing portion 72A that is fixed to an inner-circumferential surface of the outer pipe 8. As shown in FIG. 4A, the fixing portion 72A comprises two depressions 72B, 72C, which are inwardly recessed parts on the wall of the inner pipe 7. The fixing portion 72A is one of two connectors that couple the inner pipe 7 to the inner-circumferential surface of the outer pipe 8.

The two depressions 72B, 72C are configured to respectively form openings 11A, 11B that communicate the inner pipe 7 with the clearance 10 at the second inner-pipe end 72. The remaining portion of the fixing portion 72A, other than the depressions 72B, 72C (non-depressed portion), closes a space between the inner pipe 7 and the outer pipe 8 along the axis of the inner pipe 7. In other words, in a circumferential view, a part of the fixing portion 72A is separated from the inner-circumferential surface of the outer pipe 8.

The two depressions 72B, 72C are situated to face each other across the axis of the inner pipe 7. Preferably, a radius of curvature R3 of each depressions 72B, 72C is substantially the same as a maximum diameter R4 of the fixing portion 72A (which is the diameter of the non-depressed portion). This enables the circumferential length of the inner pipe 7 and thus the thickness of the inner pipe 7 to be kept unchanged before and after the process of forming the depressions 72B, 72C.

The inner pipe 7 accordingly comprises a first section including a first outer surface (in other words, non-depressed portion), and a second section including a second outer surface (in other words, depressions 72B, 72C). The second outer surface is configured to form the openings 11A, 11B and is situated closer to the center axis of the inner pipe 7 than the first outer surface.

The inner pipe 7 comprises a first-diameter portion including the first section and the second section (in other words, the second inner-pipe end 72), and a second-diameter portion having an outer diameter smaller than the diameter of the first-diameter portion (in other words, portions other than the second inner-pipe end 72).

<Outer Pipe>

Figure 4B:
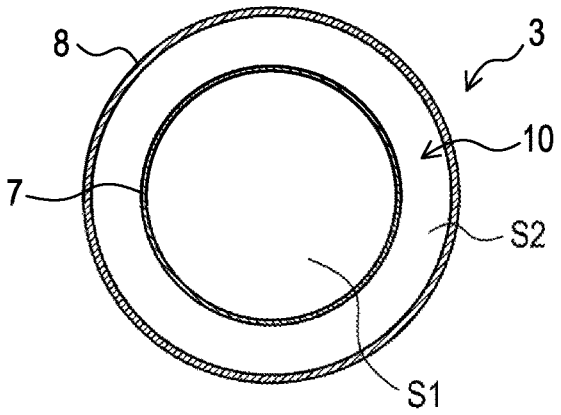
FIG. 4B is a schematic cross-sectional diagram taken along a line IVB-IVB of FIG. 2B.

As shown in FIG. 4B, the outer pipe 8 is arranged to surround an outer-circumferential surface of the inner pipe 7 (including the first and second outer surfaces). In other words, the inner pipe 7 is arranged inside the outer pipe 8. The outer pipe 8 forms a double pipe with the inner pipe 7.

An inner diameter of the outer pipe 8 is greater than an outer diameter of the inner pipe 7. An outer diameter of the outer pipe 8 in an area forming the clearance 10 (the area between the first outer-pipe end 81 and the second outer-pipe end 82, exclusive of the second outer-pipe end 82) is equal to or smaller than an outer diameter of the second outer-pipe end 82. In the present embodiment, the diameter of the outer pipe 8 is longitudinally consistent.

The double pipe comprises a first double-pipe end and a second double-pipe end. The double pipe is configured to form the first exhaust passage 12 such that one of the first double-pipe end or the second double-pipe end is coupled to a first flow passage (which is, the first pipe 5A) in an upstream of exhaust flow and the other one of the first double-pipe end or the second double-pipe end is coupled to a second flow passage (which is, the second pipe 5B) in a downstream of exhaust flow. The first exhaust passage 12 couples the first flow passage to the second flow passage via the inner pipe 7.

The outer pipe 8 comprises a first outer-pipe end 81 and a second outer-pipe end 82 both coupled to the outer-circumferential surface of the inner pipe 7. A diameter of the first outer-pipe end 81 and a diameter of the second outer-pipe end 82 are equal to each other. The second outer-pipe end 82 forms an end of the muffler 3.

The clearance 10 is situated between the inner pipe 7 and the outer pipe 8 and communicates with the first exhaust passage 12 via the openings 11A, 11B at the second outer-pipe end 82. The openings 11A, 11B are also arranged to communicate the inner pipe 7 with the outer pipe 8 at the second outer-pipe end 82.

The inclusion 9, which will be explained later, is situated in an inner side the first outer-pipe end 81. In other words, the inclusion 9 is interposed between the outer-circumferential surface of the inner pipe 7 and the inner-circumferential surface of the outer pipe 8 and closes a space between the inner pipe 7 and the outer pipe 8 near the first outer-pipe end 81.

The second outer-pipe end 82 is directly fixed by welding to the outer-circumferential surface of the fixing portion 72A of the inner pipe 7 at the non-depressed portion. The second outer-pipe end 82 extends more axially outwardly than the second inner-pipe end 72.

More specifically, in the first section of the inner pipe 7, the inner pipe 7 is bonded to the outer pipe 8 as the outer-circumferential surface of the inner pipe 7 abuts the inner-circumferential surface of the outer pipe 8; the space between the inner pipe 7 and the outer pipe 8 is therefore closed. In addition, in the second section of the inner pipe 7, a first part of the clearance 10 is formed between the outer-circumferential surface of the inner pipe 7 and the inner-circumferential surface of the outer pipe 8.

A resonance chamber 10A, corresponding to the first part of the clearance 10, is formed between an outer-circumferential surface of the second-diameter portion of the inner pipe 7 (which is, the portion other than the second inner-pipe end 72) and the inner-circumferential surface of the outer pipe 8. Two resonance pipes 10B, corresponding to second parts of the clearance 10, are formed between the second outer surface of the inner pipe 7 (in other words, depressions 72B, 72C) and the inner-circumferential surface of the outer pipe 8.

The openings 11A, 11B are individually situated in one end of the two resonance pipes 10B. The two resonance pipes 10B communicate with the first exhaust passage 12 via the corresponding openings 11A, 11B. The resonance chamber 10A communicates with the first exhaust passage 12 via the two resonance pipes 10B. Accordingly, the resonance pipes 10B and the resonance chamber 10A together function as a Helmholtz resonator.

The muffler 3 is further configured to function as the side-branch muffler due to the communication holes 73A, 73B communicating the first exhaust passage 12 with the clearance 10.

In an event that air column resonance occurs in the second exhaust passage, formed with exhaust-passage components comprising the muffler 3, each of the openings 11A, 11B is arranged at a location corresponding to a location of an antinode of standing waves in the second exhaust passage.

<Inclusion>

The inclusion 9 is a buffer interposed between the outer-circumferential surface of the inner pipe 7 at the first inner-pipe end 71 and the inner-circumferential surface of the outer pipe 8 at the first outer-pipe end 81. The inclusion 9 is another one of two connectors that couple the inner pipe 7 to the inner-circumferential surface of the outer pipe 8.

Figure 4C:
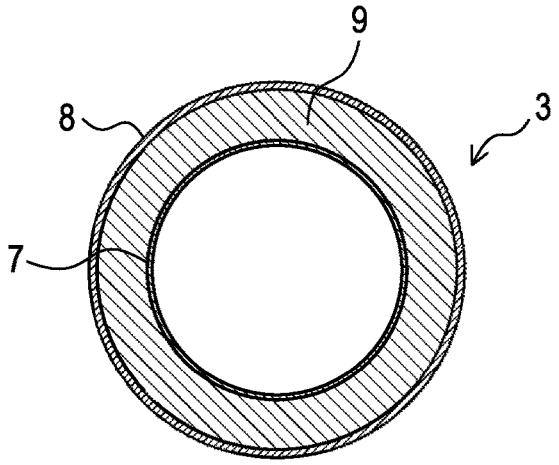
FIG. 4C is a schematic cross-sectional diagram taken along a line IVC-IVC of FIG. 2B.

As shown in FIG. 4C, the inclusion 9 is situated entirely along the outer-circumferential surface of the inner pipe 7 and the inner-circumferential surface of the outer pipe 8 in a circumferential view. In other words, the inclusion 9 is situated along the axis of the inner pipe 7 to close the space between the inner pipe 7 and the outer pipe 8.

The inclusion 9 may include an opening along the circumference as long as the clearance 10 does not lose its function as the side branch (explained later). A characteristic frequency of resonance can be adjusted by changing the size of this opening.

The inclusion 9 may be any inclusion as long as the clearance 10 can be formed as a side branch, and as long as the inclusion can slide at least with respect to the inner pipe 7 or the outer pipe 8. Preferably, the inclusion 9 is air permeable, for example, metallic wire mesh.

<Clearance>

The clearance 10 is a semi-hermetic space defined by the outer-circumferential surface of the inner pipe 7, the inner-circumferential surface of the outer pipe 8, the fixing portion 72A, and the inclusion 9.

The clearance 10 communicates with the inside of the inner pipe 7 via the first communication hole 73A and the second communication hole 73B, and the two depressions 72B, 72C. The clearance 10 reduces a sound in a particular frequency. The characteristic frequency of the clearance 10 can be adjusted by changing the locations of the first communication hole 73A and the second communication hole 73B.

<Relationship between Inner pipe, Outer pipe, and Clearance>

As shown in FIG. 4B, a cross-sectional area S2 of the clearance 10 is equal to or smaller than a cross-sectional area S1 of a hollow part of the inner pipe 7.

The inner pipe 7 may have a lower intensity than the outer pipe 8. Accordingly, an average thickness of the inner pipe 7 (in other words, an average thickness of a plate that forms the inner pipe 7) may preferably be equal to or less than an average thickness of the outer pipe 8 (in other words, an average thickness of a plate member that forms the outer pipe 8). In the present embodiment, the inner pipe 7 and the outer pipe 8 are coaxially arranged with each other. Nevertheless, the inner pipe 7 and the outer pipe 8 need not be coaxial with each other.

A distance between an end of the clearance 10 along the axis of the inner pipe 7 and the communication hole closest to this end is different from a distance between the communication holes. In other words, a distance between the first inner-pipe end 71 and the first communication hole 73A, a distance between the first communication hole 73A and the second communication hole 73B, and a distance between the second communication hole 73B and the second inner-pipe end 72 are all different from each other. The circumferential location of each of the communication holes 73A, 73B on the inner pipe 7 is not particularly limited.

[1-2. Effect]

The following effects can be obtained according to the embodiment precisely explained above.

(1a) Due to the side-branch muffler formed by the clearance 10, which communicates with the first exhaust passage 12, muffling in two or more frequencies is possible.

(1b) Due to the openings 11A, 11B that communicate with the clearance 10 being situated in the second inner-pipe end 72 of the inner pipe 7, muffling by Helmholtz resonance and muffling by the side branch are compatible with each other.

(1c) Since the cross-sectional area of the clearance 10 is equal to or smaller than the cross-sectional area of the hollow part of the inner pipe 7, and also since the outer diameter of the outer pipe 8 in the area forming the clearance 10 is equal to or smaller than the outer diameter of the second outer-pipe end 82, the outer diameter of the muffler 3 can be reduced to save space for installation. In addition, since the muffler 3 can be bent, the muffler 3 can be more flexibly arranged.

(1d) Due to the communication holes 73A, 73B axially situated away from each other along the inner pipe 7, two or more side branches, each designed for different frequency, can be formed on the clearance 10. Accordingly, muffling effect can be exerted on increased number of frequencies.

Figure 5A:
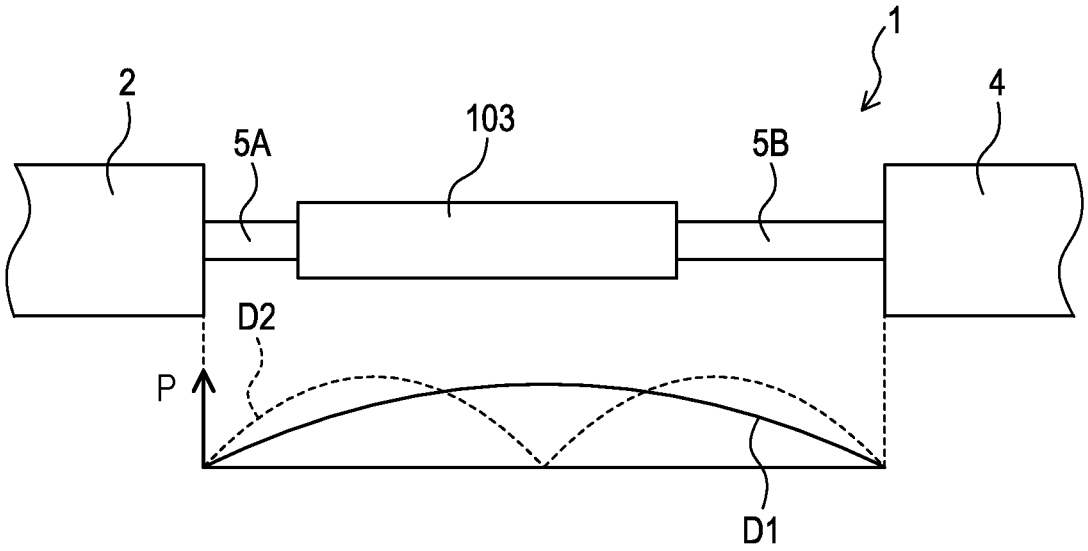
FIG. 5A, 5B are schematic diagrams describing relationships between communication holes and standing waves.
Figure 5B:
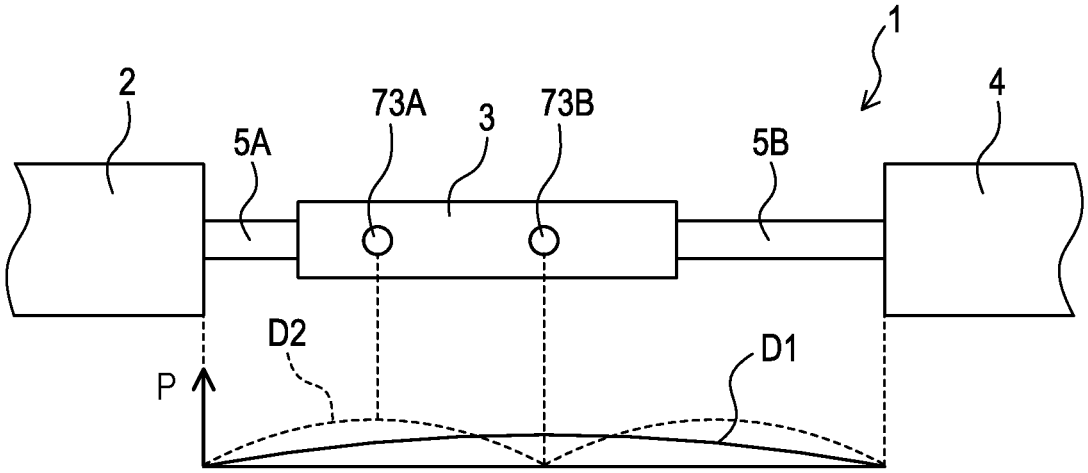

FIG. 5A shows a configuration of an exhaust pipe 103 having no communication holes corresponding to the communication holes 73A, 73B, and a sound pressure P in the exhaust pipe 103. FIG. 5B shows the muffler 3 having the communication holes 73A, 73B, and a sound pressure P in the muffler 3.

In an event that air column resonance occurs in the second exhaust passage in the muffler 3 in FIG. 5B, the second communication hole 73B is situated to correspond to an antinode of a standing wave D1 of a first mode generated in the exhaust system 1 and the first communication hole 73A is situated to correspond to an antinode of a standing wave D2 of a second mode. Accordingly, muffling effect can be more reliable.

(1e) Due to an installation of the inclusion 9 between the outer pipe 8 and the inner pipe 7 as an alternative for bonding the outer pipe 8 and the inner pipe 7 together, the outer pipe 8 can axially slide with respect to the inner pipe 7 when there is a difference in thermal expansion between the inner pipe 7 and the outer pipe 8. Accordingly, stress concentration at the connected areas of the inner pipe 7 and the outer pipe 8 can be reduced, which can lead to a reduction of occurrence of cracks.

2. Second Embodiment

[2-1. Configuration]

Figure 6:
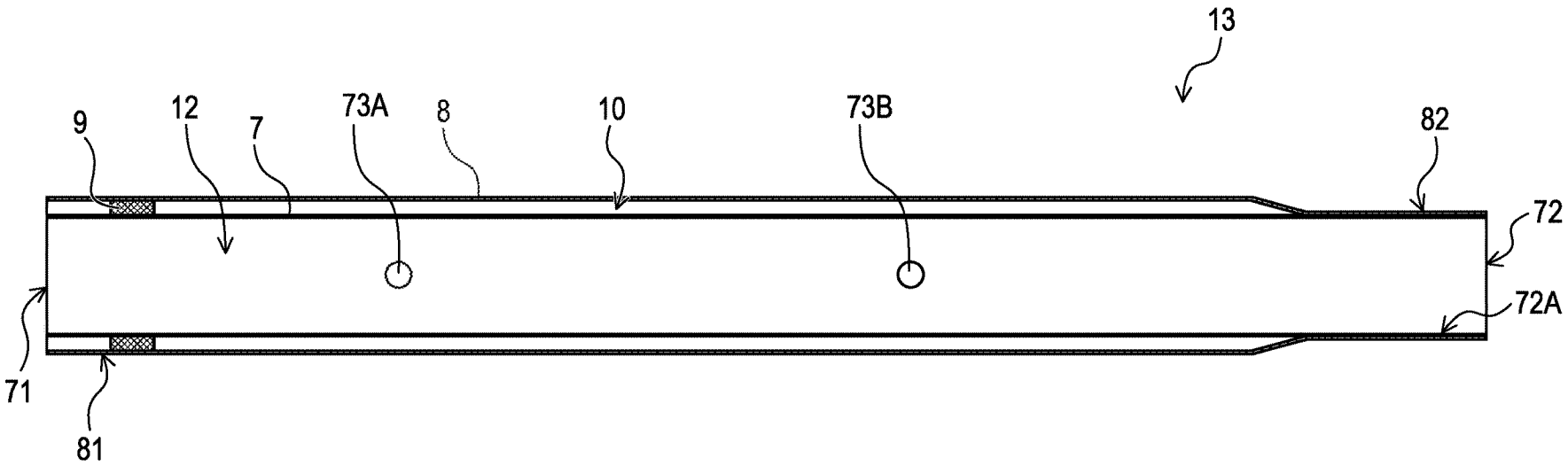
FIG. 6 is a schematic cross-sectional diagram corresponding to FIG. 2B, showing a muffler in an embodiment different from the embodiment in FIG. 2A.

As shown in FIG. 6, a muffler 13 is used in the exhaust system 1 as an alternative for the muffler 3 in FIG. 1. The muffler 13 comprises the inner pipe 7, the outer pipe 8, and the inclusion 9. The muffler 13 has the double-pipe structure.

The inner pipe 7, the outer pipe 8, and the inclusion 9 in the muffler 13 are the same as the inner pipe 7, the outer pipe 8, and the inclusion 9 in the muffler 3 shown in FIG. 2A, 2B except for the following point. Thus, detailed explanations of the same components are omitted.

In the present embodiment, a full circumference of the second outer-pipe end 82 is welded to the inner pipe 7. In other words, the inner pipe 7 does not comprise the depressions 72B, 72C in the second inner-pipe end 72. The outer shape of the second inner-pipe end 72 is a circle.

The muffler 13 accordingly does not comprise the openings 11A, 11B unlike the muffler 3 in FIG. 2A, 2B. There is thus no resonance pipe 10B formed in the muffler 13. Therefore, the muffler 13 functions only as a side-branch muffler but not as a Helmholtz resonator.

[2-2. Effect]

According to the aforementioned embodiment, the following effect can be obtained.

(2a) Since the side-branch muffler is formed by the clearance 10 that communicates with the first exhaust passage 12, sound muffling in two or more frequencies becomes possible.

3. Other Embodiments

Although the embodiments of the present disclosure have been explained hereinbefore, the present disclosure may be achieved in various modifications without being limited to the aforementioned embodiments.

(3a) In the mufflers 3, 13 in the aforementioned embodiments, the inner pipe 7 may comprise a single communication hole. In addition, the inner pipe 7 may comprise three or more communication holes separately situated away from each other along the axis of the inner pipe 7.

Figure 7A:
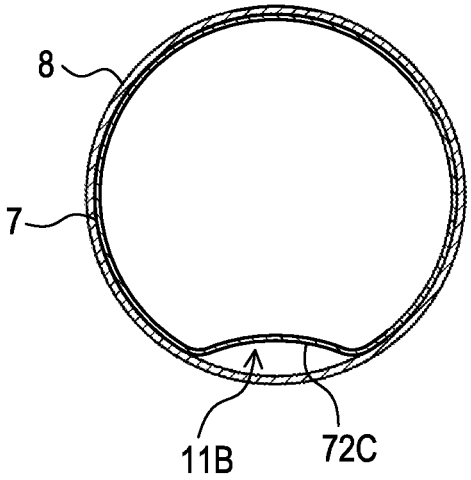
FIG. 7A, 7B, 7C are schematic cross-sectional diagrams corresponding to FIG. 4A showing a fixing portion in an embodiment different from the embodiment in FIG. 2A.
Figure 7B:
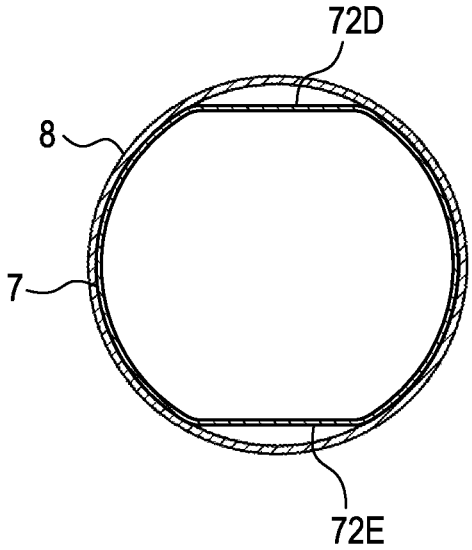
Figure 7C:
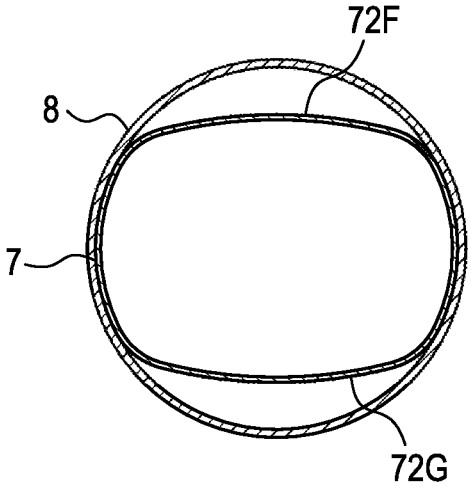

(3*b*) As shown in FIG. 7A, the fixing portion 72A of the muffler 3 in the aforementioned embodiment may comprise only a single opening 11B (in other words, the depression 72C). As alternatives for the depressions, the fixing portion 72A may comprise planes 72D, 72E having a chordal section as shown in FIG. 7B, or protrusions 72F, 72G protruding radially outwardly as shown in FIG. 7C.

(3c) The mufflers 3, 13 in the aforementioned embodiments both need not comprise the inclusion 9. In other words, the two connectors of the inner pipe 7 may both be fixing portions fixed to the inner-circumferential surface of the outer pipe 8. Specifically, the first inner-pipe end 71 may be directly fixed to the first outer-pipe end 81 instead of being coupled to the first outer-pipe end 81 via the inclusion 9. In this case, the clearance 10 is defined by the outer-circumferential surface of the inner pipe 7, the inner-circumferential surface of the outer pipe 8, and two fixing portions.

(3d) In the mufflers 3, 13 in the aforementioned embodiments, an inclusion may be interposed between the second inner-pipe end 72 and the second outer-pipe end 82. In other words, the space between the inner pipe 7 and the outer pipe 8 may be closed by interposing the inclusion between the outer-circumferential surface of the inner pipe 7 and the inner-circumferential surface of the outer pipe 8.

(3e) In the mufflers 3, 13 in the aforementioned embodiments, the outer diameter of the outer pipe 8 in the area forming the clearance 10 need not be equal to or smaller than the outer diameter of the second outer-pipe end 82.

Also, the cross-sectional area of the clearance 10 need not be equal to or smaller than the cross-sectional area of the hollow part of the inner pipe 7.

(3*f*) Functions of one element in the aforementioned embodiments may be achieved by two or more elements. Functions of two or more elements in the aforementioned embodiments may be achieved by one element. A part of the configuration of the aforementioned embodiments may be omitted. At least a part of the configuration of the aforementioned embodiments may be added to or replaced with another part of the configuration of the aforementioned embodiments. It should be noted that any and all modes that are encompassed in the technical ideas that are defined by the languages in the claims are embodiments of the present disclosure.

4. Example

Hereinafter, comparison between examples 1, 2 and a comparative example 1, conducted to confirm effects of the present disclosure, will be explained.

Figure 8A:
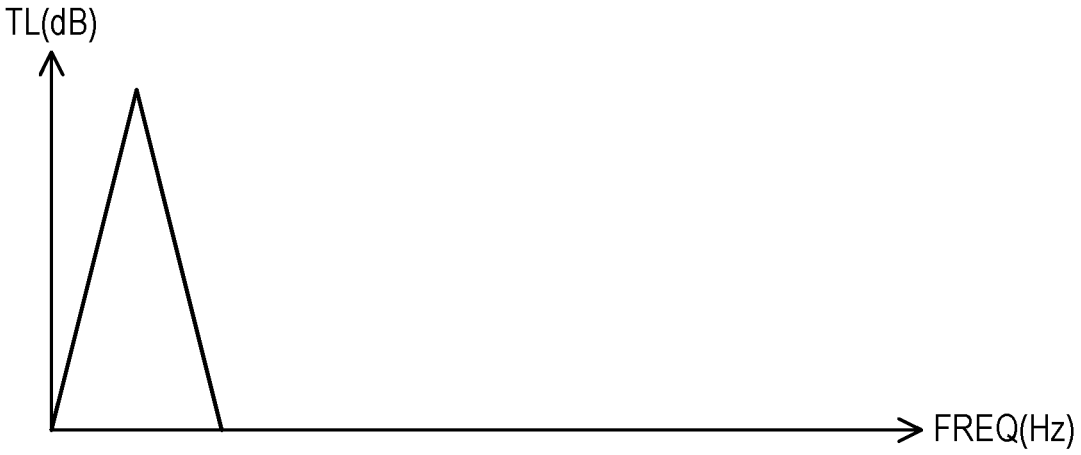
FIG. 8A is a graph showing a relationship between a frequency and muffled sound in a comparative example 1.
Figure 8B:
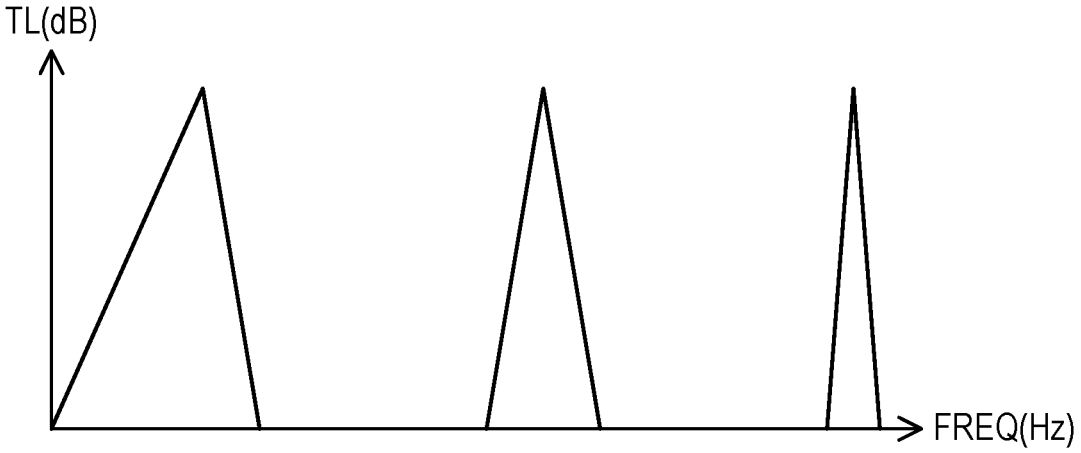
FIG. 8B is a graph showing a relationship between a frequency and muffled sound in an example 1.
Figure 8C:
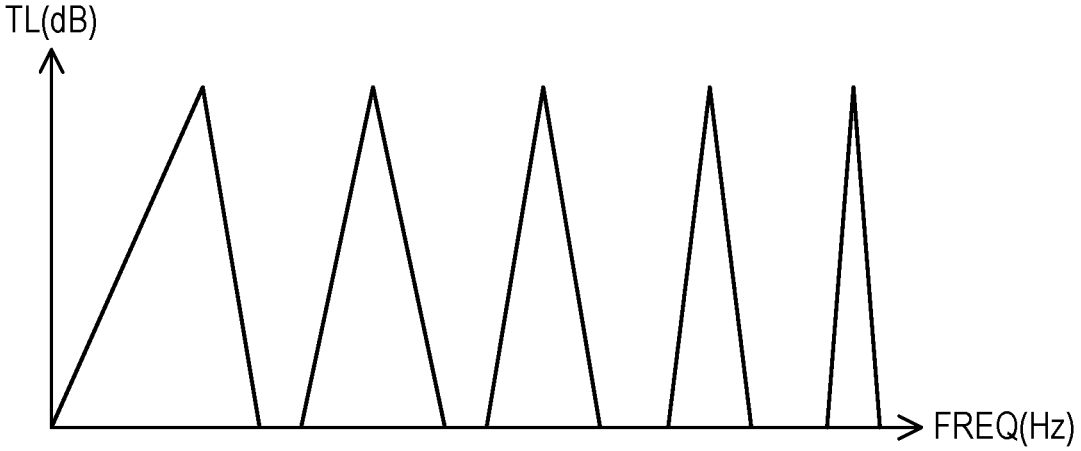
FIG. 8C is a graph showing a relationship between a frequency and muffled sound in an example 2.

The comparative example 1 is the muffler 3 in FIG. 2B with no communication holes on the inner pipe 7. The example 1 is the muffler 3 in FIG. 2B with one communication hole on the inner pipe 7. The example 2 is the muffler 3 in FIG. 2B with two communication holes on the inner pipe 7. FIG. 8A, 8B, 8C each show a relationship between the frequency (horizontal axis) and the muffled sound in decibels (vertical axis) in the comparative example 1 and the examples 1, 2.

In the comparative example 1, the clearance 10 functions as the resonance chamber that is coupled to the inner pipe 7. Thus, as shown in FIG. 8A, there is only one frequency of the muffled sound (in other words, only one peak of the muffled sound).

In contrast to the comparative example 1, the clearance 10 functions as the side branch in the example 1 as shown in FIG. 8B. Thus, muffling effect can be exerted to two or more frequencies. In the lowest frequency range (the most left in the graph) in FIG. 8B, muffling effects by the Helmholtz resonance and the side branch are combined.

As shown in FIG. 8C, as the number of communication holes on the inner pipe 7 is increased, the number of frequencies subject to the muffling effect can also be increased.

What is claimed is:

1. A muffler comprising:

an inner pipe having a cylindrical shape; and an outer pipe having a cylindrical shape, the inner pipe being situated in an inner side of the outer pipe and the inner pipe and the outer pipe together forming a double pipe, wherein the double pipe comprises a first double-pipe end and a second double-pipe end, wherein the double pipe is configured to form a first exhaust passage coupling a first flow passage to a second flow passage via the inner pipe such that one of the first double-pipe end or the second double-pipe end is coupled to the first flow passage in an upstream of exhaust flow and the other one of the first double-pipe end or the second double-pipe end is coupled to the second flow passage in a downstream of the exhaust flow, wherein a clearance is provided between the inner pipe and the outer pipe, wherein an opening connecting the inner pipe to the outer pipe is provided at the second double-pipe end, wherein the clearance communicates with the first exhaust passage via the opening, wherein the inner pipe comprises an outer-circumferential surface, wherein the outer-circumferential surface includes, at the second double-pipe end, a first outer surface, and a second outer surface that forms the opening and is situated closer to the center axis of the inner pipe than the first outer surface is, wherein a space between the inner pipe and the outer pipe is closed due to a contact between the first outer surface of the inner pipe and an inner-circumferential surface of the outer pipe, or with an inclusion interposed between the first outer surface of the inner pipe and the inner-circumferential surface of the outer pipe, wherein a first part of the clearance is formed between the first outer surface of the inner pipe and the inner-circumferential surface of the outer pipe, wherein the outer-circumferential surface of the inner pipe comprises two or more communication holes that communicate the inner pipe with the clearance, the two or more communication holes being situated away from each other along an axis of the inner pipe, wherein the two or more communication holes include a first communication hole which is situated closest to the first double-pipe end and a second communication hole, which is arranged adjacent to the first communication hole along the axis of the inner pipe, and wherein a distance between the first communication hole and the second communication hole is greater than a first distance from the first double-pipe end to the first communication hole, and greater than a second distance from the second double pipe end to the second communication hole.

2. The muffler according to claim 1, wherein the inner pipe comprising a first-diameter portion, and a second-diameter portion having an outer diameter smaller than an outer diameter of the first-diameter portion, wherein a resonance chamber, corresponding to the first part of the clearance, is formed between an outer-circumferential surface of the second-diameter portion and the inner-circumferential surface of the outer pipe, wherein the first-diameter portion comprises the first outer surface and the second outer surface, wherein a resonance pipe, corresponding to a second part of the clearance, is formed between the second outer surface and the inner-circumferential surface of the outer pipe, wherein the opening is situated in one end of the resonance pipe, wherein the resonance pipe and the resonance chamber function as a Helmholtz resonator due to the resonance pipe communicating with the first exhaust passage via the opening and due to the resonance chamber communicating with the first exhaust passage via the resonance pipe, and wherein the muffler functions as a side-branch muffler due to the first exhaust passage communicating with the clearance via the two or more communication holes.

3. The muffler according to claim 1, wherein an outer diameter of the outer pipe in an area forming the clearance is equal to or smaller than an outer diameter of the outer pipe at the second double-pipe end.

4. The muffler according to claim 1, wherein the opening is arranged at a location corresponding to a location of an antinode of standing waves in a second exhaust passage, the second exhaust passage being formed with exhaust-passage components comprising the muffler.

5. The muffler according to claim 1, wherein the inner pipe is bonded with the outer pipe as the first outer surface contacts the inner-circumferential surface of the outer pipe.

6. The muffler according to claim 1, wherein a space between the inner pipe and the outer pipe is closed with an inclusion interposed between the outer-circumferential surface of the inner pipe and the inner-circumferential surface of the outer pipe near the first double-pipe end.

7. The muffler according to claim 6, wherein the inclusion is wire mesh.

8. The muffler according to claim 1, wherein the inner pipe is bonded with the outer pipe near the second double-pipe end as the first outer surface contacts the inner-circumferential surface of the outer pipe.

9. The muffler according to claim 1, wherein the two or more communication holes are arranged at locations each corresponding to a location of an antinode of standing waves in a second exhaust passage, the second exhaust passage being formed with exhaust-passage components comprising the muffler.

* * * * *